US007721722B1

(12) United States Patent
Tulkis

(10) Patent No.: US 7,721,722 B1
(45) Date of Patent: May 25, 2010

(54) WATER-POWERED TOY GUNS AND METHOD

(76) Inventor: Peter Tulkis, 266 Central Ave., Paramus, NJ (US) 07652

( * ) Notice: Subject to any disclaimer, the term of this patent is extended or adjusted under 35 U.S.C. 154(b) by 18 days.

(21) Appl. No.: 11/924,732

(22) Filed: Oct. 26, 2007

(51) Int. Cl.
*F41B 11/28* (2006.01)

(52) U.S. Cl. ..... 124/73; 124/65; 124/69

(58) Field of Classification Search ..... 124/69, 124/70, 75, 56, 63; 417/40
See application file for complete search history.

(56) References Cited

U.S. PATENT DOCUMENTS

| | | | | |
|---|---|---|---|---|
| 1,167,178 | A * | 1/1916 | Hill | 124/56 |
| 1,183,644 | A * | 5/1916 | Hill | 124/75 |
| 1,324,772 | A * | 12/1919 | Goodyear | 124/75 |
| 2,000,607 | A | 5/1935 | Peake | |
| 2,601,555 | A | 6/1952 | Pope | |
| 2,762,356 | A | 9/1956 | Foster | |
| 3,022,597 | A | 2/1962 | Rucker | |
| 3,739,764 | A | 6/1973 | Allport | |
| 3,938,272 | A | 2/1976 | Ditto et al. | |
| 4,376,327 | A | 3/1983 | Curtis | |
| 4,712,274 | A | 12/1987 | Curtis | |
| 4,854,480 | A | 8/1989 | Shindo | |
| 4,892,081 | A | 1/1990 | Moormann | |
| 4,897,065 | A | 1/1990 | Fertig et al. | |
| 5,242,323 | A | 9/1993 | Rappaport | |
| 5,267,549 | A | 12/1993 | Webber | |
| 5,343,850 | A | 9/1994 | Steer | |
| 5,373,833 | A | 12/1994 | D'Andrade | |
| 5,538,453 | A | 7/1996 | Johnson | |
| 5,553,598 | A | 9/1996 | Johnson et al. | |
| 5,653,215 | A | 8/1997 | Chung et al. | |
| 5,653,216 | A * | 8/1997 | Johnson | 124/69 |
| 5,819,717 | A | 10/1998 | Johnson et al. | |
| 6,192,612 | B1 | 2/2001 | Maier et al. | |
| 6,527,518 | B2 * | 3/2003 | Ostrowski | 417/40 |
| 6,904,901 | B2 | 6/2005 | Mitchell | |
| 7,163,009 | B2 | 1/2007 | Brown et al. | |
| 2005/0016514 | A1 * | 1/2005 | Nadel | 124/56 |
| 2005/0183711 | A1 * | 8/2005 | Eichner et al. | 124/73 |
| 2007/0012305 | A1 | 1/2007 | Williams | |

* cited by examiner

*Primary Examiner*—Michael Carone
*Assistant Examiner*—Reginald Tillman, Jr.
(74) *Attorney, Agent, or Firm*—Arthur Jacob

(57) ABSTRACT

A toy gun is operated by water under pressure, supplied from a conveniently available source of water under pressure, such as a garden hose connected to a municipal water supply, a household water supply, or a similar source of water under pressure, to launch a projectile, such as a water-filled balloon, along, and preferably through, the barrel of the gun. The projectile is coupled with a firing chamber, preferably by being placed in the firing chamber, adjacent the barrel, and water under pressure is admitted to an actuator for actuating an air compressor which, in turn, creates compressed air that is accumulated in an air chamber and then selectively released to the firing chamber to launch the projectile from the barrel.

20 Claims, 13 Drawing Sheets

WATER-POWERED TOY GUNS AND METHOD

The present invention relates generally to toy guns and pertains, more specifically, to a toy gun and method utilized to launch a projectile in response to pressurized air, powered by water under pressure supplied from a readily available source of water under pressure.

Toy guns have been popular playthings for a very long time. In particular, toy guns which utilize pressurized air to launch a projectile have gained widespread appeal among both children and adults. Toy guns of this type have been adapted to launch a variety of projectiles, most of which are generally lightweight items, such as synthetic polymeric foam balls, Ping-Pong balls, air-filled balloons, and the like, requiring only modestly elevated air pressure to propel the projectiles over a minimally satisfactory range.

Launching a projectile over a longer range requires concomitant higher air pressure, not easily attained with current toy gun constructions and operating procedures. Moreover, the launching of heavier projectiles, such as water-filled balloons, paint balls and similar objects, requires higher air pressure for attaining reasonable results. Further, the repetitive generation of higher air pressure for serial launchings is not easily accomplished in currently available air pressure-operated toy gun constructions and procedures. In general, the effort required to generate higher air pressures in previous toy guns, and to do so repetitively, has discouraged the use of such toy guns beyond the leisurely launching of relatively lightweight projectiles over a modest range.

The present invention provides a toy gun and method of operation which overcomes the aforesaid drawbacks of previous toy guns of the type described above. As such, the present invention attains several objects and advantages, some of which are summarized as follows: Provides a toy gun powered by a conveniently available source of water under pressure, such as a garden hose connected to a municipal water supply, a household water supply or a similar source of water under pressure, to generate pressurized air for launching a projectile; enables the launching of serial projectiles repetitively with minimal effort, in response to pressurized air; allows the launch of projectiles of relatively higher weight, such as water-filled balloons, in response to readily-generated pressurized air in a toy gun; launches projectiles over a greater range utilizing pressurized air made readily available in a toy gun; simplifies the operation of a toy gun in which pressurized air is utilized for launching a projectile; reduces the effort needed to establish pressurized air within a toy gun which launches a projectile in response to pressurized air; increases the amusement value of toy guns of the type which launch a projectile in response to pressurized air, by reducing the effort required to establish requisite air pressure within the toy gun; provides a toy gun construction and operating procedure which attains exemplary performance over an extended service life.

The above objects and advantages, as well as further objects and advantages, are attained by the present invention, which may be described briefly as a toy gun for launching a projectile in response to pressurized air, the toy gun being powered by water under pressure supplied from an available source of water under pressure, the toy gun comprising: a barrel for launching the projectile; a firing chamber for being coupled with the projectile to be launched, the firing chamber communicating with the barrel; an air chamber; a trigger valve located between the firing chamber and the air chamber for selectively opening and closing communication between the firing chamber and the air chamber; an air compressor communicating with the air chamber for supplying air under pressure to the air chamber; an actuator coupled with the air compressor for operating the air compressor to supply air under pressure to the air chamber; and a water coupling arrangement for coupling the actuator with the source of water under pressure; the actuator being configured for operation in response to water under pressure such that upon introducing water under pressure to the actuator, the actuator will operate the air compressor to supply air under pressure to the air chamber, whereby upon coupling of a projectile with the firing chamber, operation of the trigger valve to selectively open communication between the air chamber and the firing chamber will release air under pressure from the air chamber to the firing chamber for launching the projectile along the barrel.

In addition, the present invention provides a method for launching a toy projectile utilizing water under pressure, from an available source of water under pressure, comprising: coupling the projectile with a firing chamber adjacent a barrel; admitting water under pressure from the source of water under pressure into an actuator coupled with an air compressor to create compressed air in response to admitting water under pressure into the actuator; accumulating the compressed air in an air chamber; and subsequently opening communication between the air chamber and the firing chamber, such that the open communication provides the firing chamber with an essentially instantaneous volume of compressed air under pressure sufficient to effect launching of the projectile along the barrel.

The present invention will be understood more fully, while still further objects and advantages will become apparent, in the following detailed description of preferred embodiments of the invention illustrated in the accompanying drawing, in which.

Figure 1:
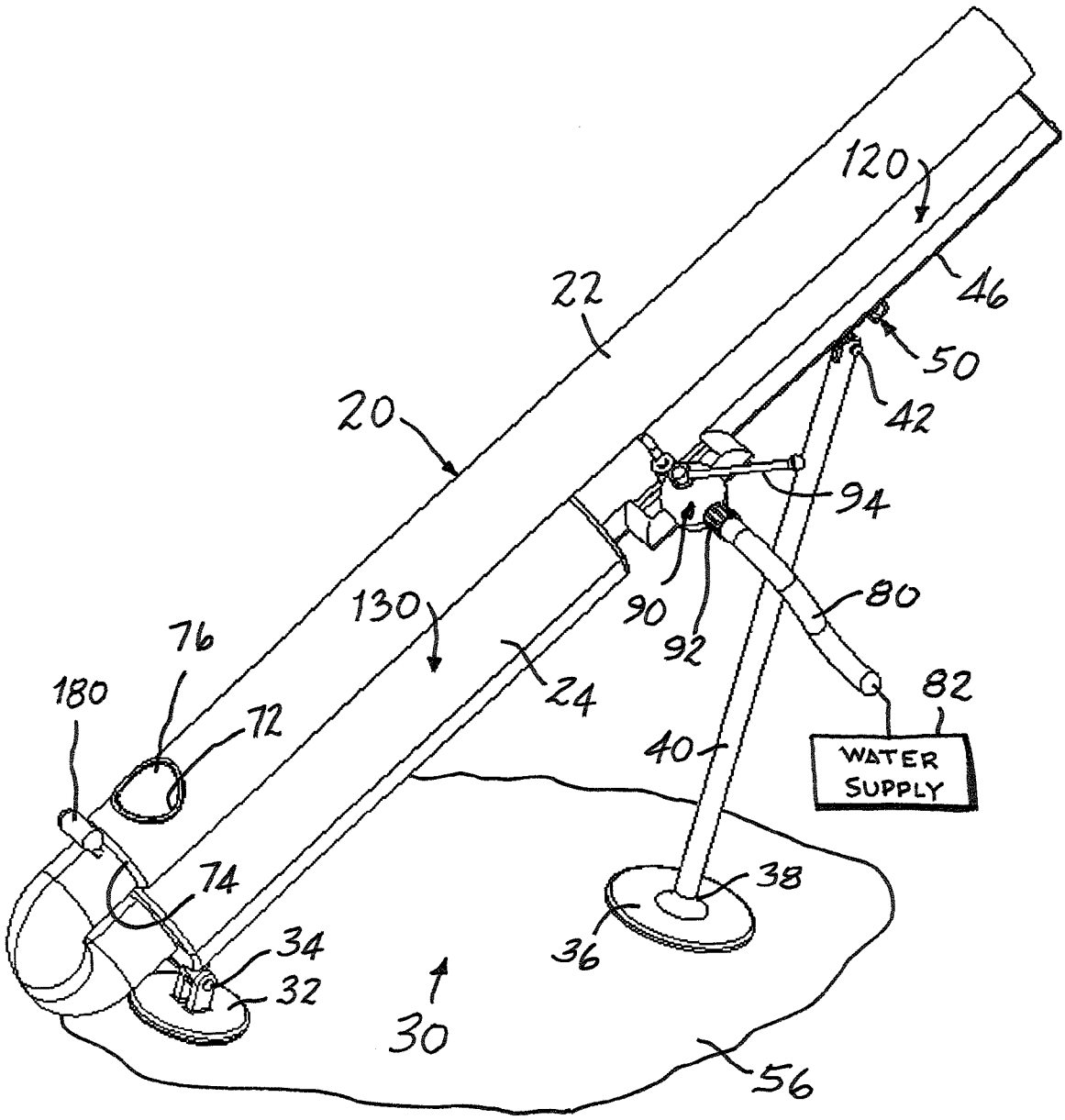
FIG. 1 is a pictorial view of a toy gun constructed in accordance with the present invention.
Figure 2:
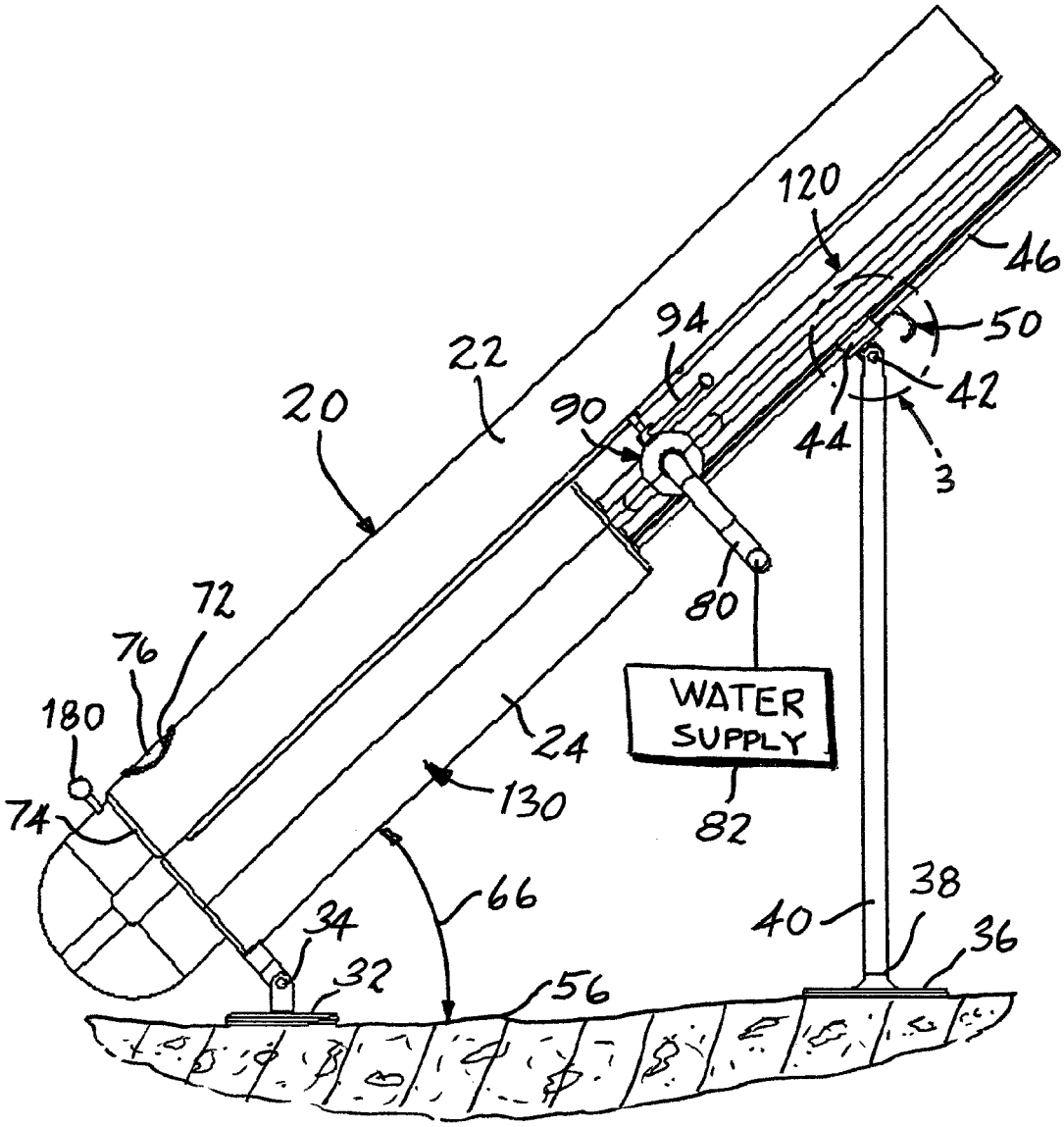
FIG. 2 is a side elevational view of the toy gun.
Figure 3:
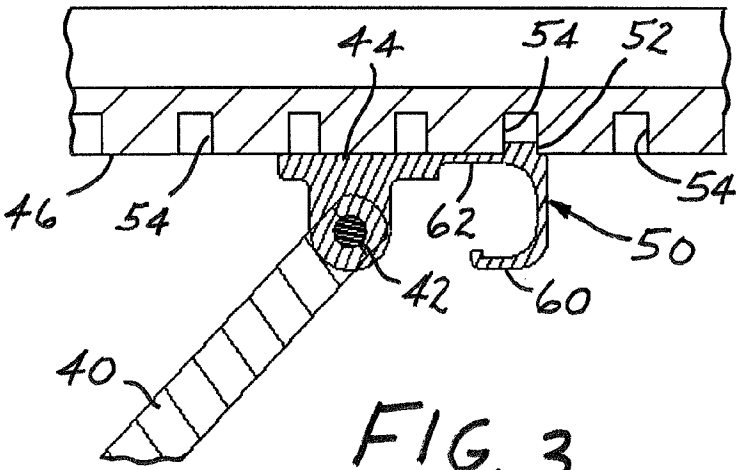
FIG. 3 is an enlarged fragmentary cross-sectional view of a portion 3 of FIG. 2.
Figure 4:
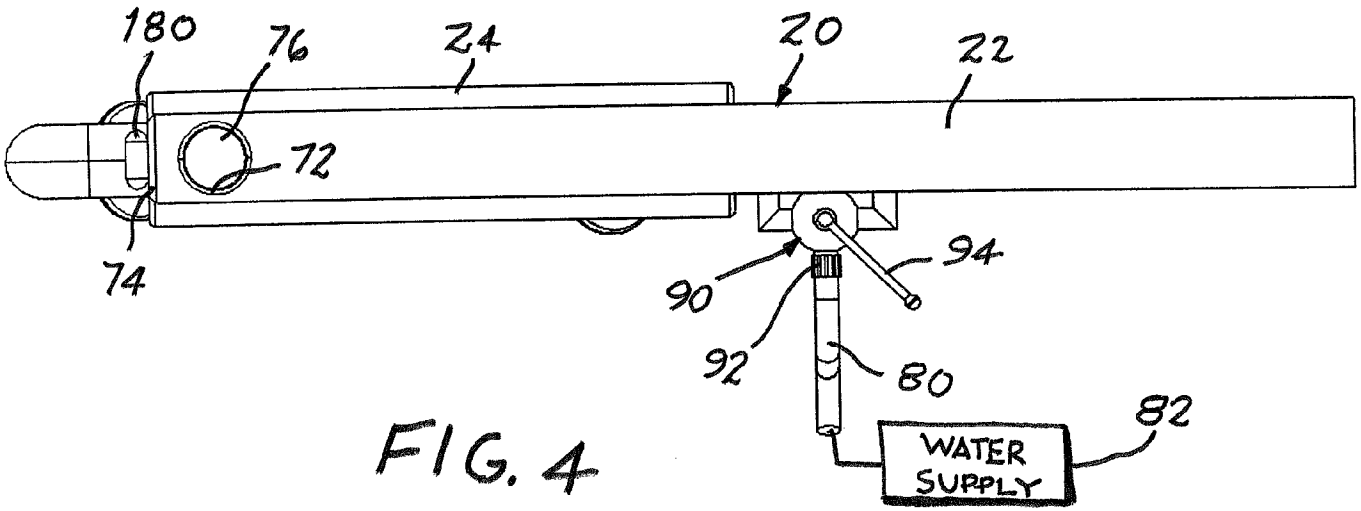
FIG. 4 is a top plan view of the toy gun.

Referring now to the drawing, and especially to FIGS. 1 through 4 thereof, a toy gun constructed in accordance with the present invention is shown at 20 and is seen to include a barrel 22 and an operating mechanism 24 integrated with the barrel 22 and selectively operated to effect launching of a projectile along the barrel 22. In the preferred embodiment, a projectile is to be launched through the barrel 22, as described below. A stand 30 includes a rear foot 32 mounted for pivotal movement at a rear pivotal connection 34, and a forward foot 36 affixed to the lower end 38 of a post 40 which extends upwardly from forward foot 36 to a forward pivotal connection 42 which connects post 40 with a slide 44.

Slide 44 is slidable along a track 46 which extends in a direction essentially parallel to the barrel 22 and may be locked in one of several locations along the track 46 by a lock 50 which includes a latch pin 52 selectively engaged with a complementary one of several sockets 54 spaced apart along the length of track 46. Upon placement of the feet 32 and 36 upon a given surface, such as horizontal ground surface 56, slide 44 may be freed selectively for movement along track 46 by gripping finger grip 60 of lock 50 and pulling downwardly to flex latch arm 62 of lock 50 and displace latch pin 52 away from track 46, enabling slide 44 to be moved along track 46 to any selected location where latch pin 52 then can be engaged with a corresponding socket 54 to lock slide 44 in place at the selected location. The lock 50, together with the pivotal connections 34 and 42, enables the placement of barrel 22 at a desired angle of inclination 66 for subsequent launching of a projectile, as will be described in detail below.

Figure 5:
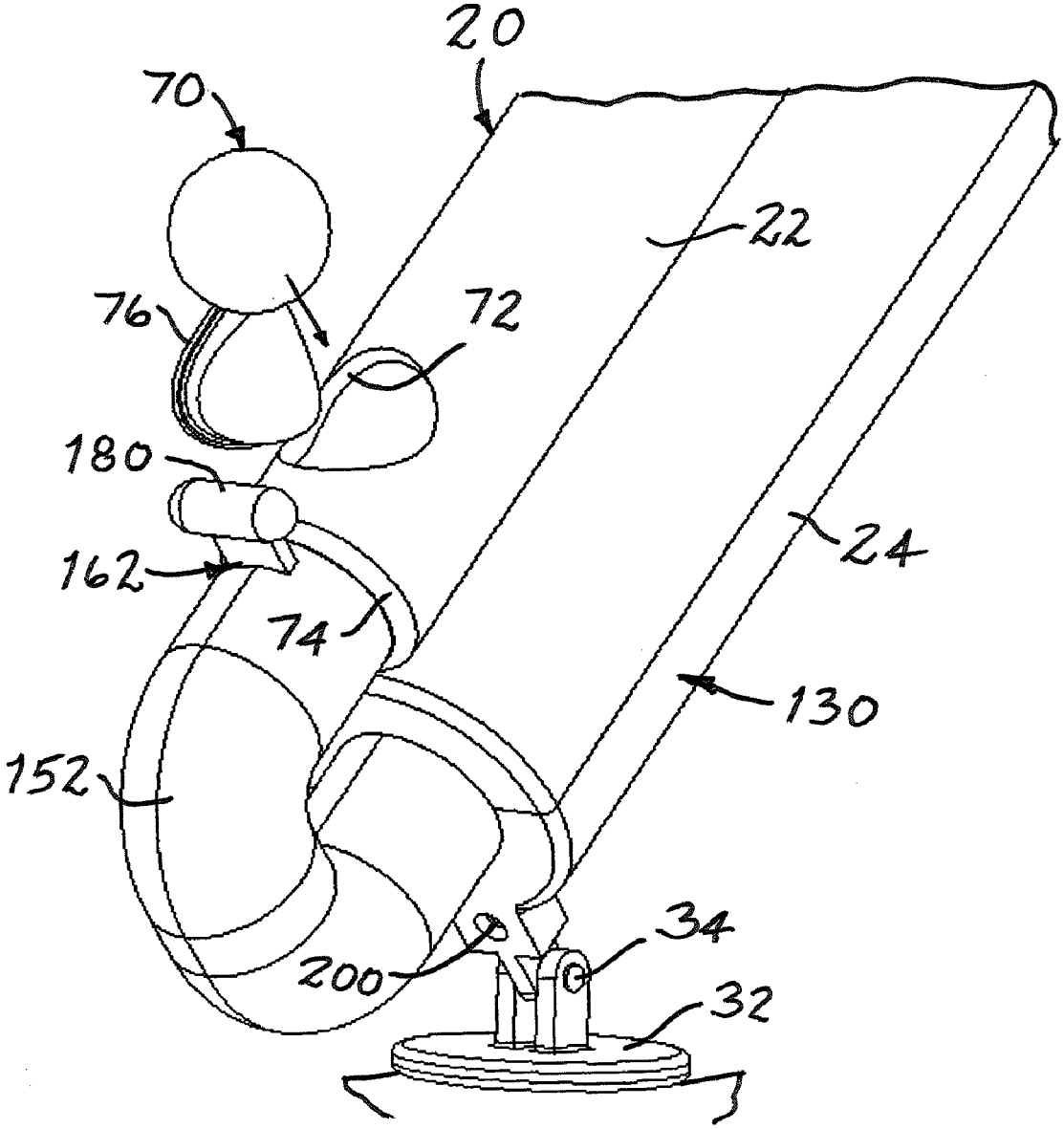
FIG. 5 is a fragmentary, top, rear, right side pictorial view of the toy gun.

In the illustrated preferred embodiment, once the barrel 22 is placed at the desired angle of inclination 66, a projectile, shown in FIG. 5 in the form of a water-filled balloon 70, is inserted into gun 20 through a loading port 72 adjacent the lower rearward end 74 of the barrel 22, and the loading port 72 is sealed shut by means of a cover 76 which is fitted over the loading port 72 subsequent to insertion of the balloon 70.

Toy gun 20 is powered by water under pressure supplied by a conveniently available source of water under pressure, such as a garden hose 80 connected to a municipal water supply, a household water supply or a similar source of water under pressure, shown as a water supply 82. Toy gun 20 is coupled with water supply 82, through garden hose 80, by a water coupling arrangement which includes an operating valve assembly in the form of a water valve 90 coupled to garden hose 80 by a coupling 92. A valve lever 94 operates water valve 90 selectively to power the toy gun 20 as described below in connection with FIGS. 6 through 8.

Figure 6:
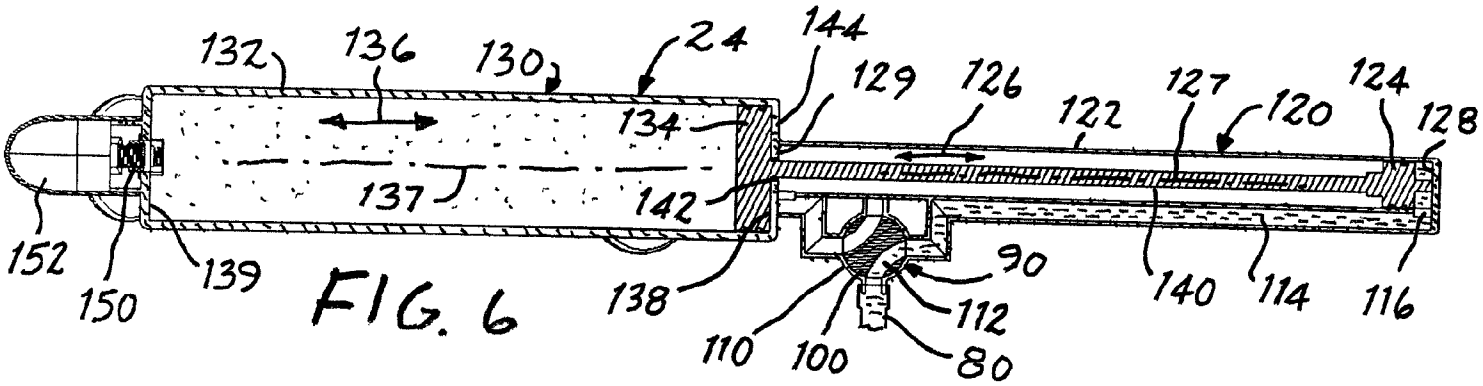
FIGS. 6, 7 and 8 are diagrammatic longitudinal cross-sectional views illustrating various stages during a cycle of operation of the toy gun.

Turning first to FIG. 6, water valve 90 includes a valve core 100 which is rotated within a valve housing 110 by operation of the valve lever 94. In the position shown in FIG. 6, valve core 100 directs incoming water from the garden hose 80 through a first valve passage 112 to a conduit 114 which passes the incoming water to a first opening 116 in an actuator 120 which includes a water cylinder 122 and a water piston 124 placed within the water cylinder 122 for reciprocating movement in opposite directions 126 along the water cylinder 122, the movement preferably being longitudinal movement along a linear path of travel 127 between a near end 128 and a far end 129 of the water cylinder 122.

In the preferred arrangement, an air compressor 130 is placed in tandem with actuator 120 and includes an air cylinder 132 and an air piston 134 placed within the air cylinder 132 for reciprocating movement in opposite directions 136 along the air cylinder 132, the movement preferably being longitudinal movement along a linear path of travel 137 between a near end 138 and a far end 139 of the air cylinder 132. Air piston 134 is coupled for movement with water piston 124 by a common connecting rod 140 which passes between the water cylinder 122 and the air cylinder 132, through a seal 142 located at the far end 129 of the water cylinder 122 which, in the illustrated embodiment, is coincident with the near end 138 of air cylinder 132.

Figure 7:
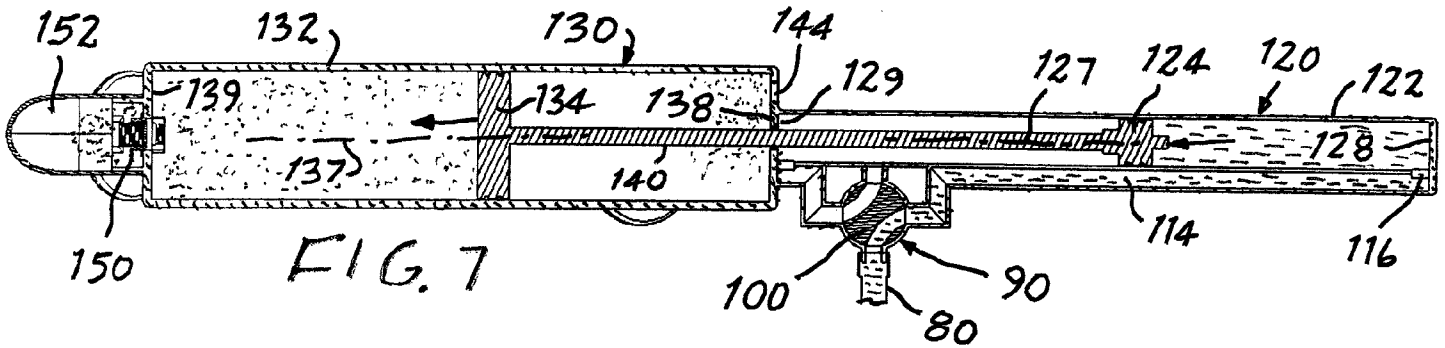
Figure 8:
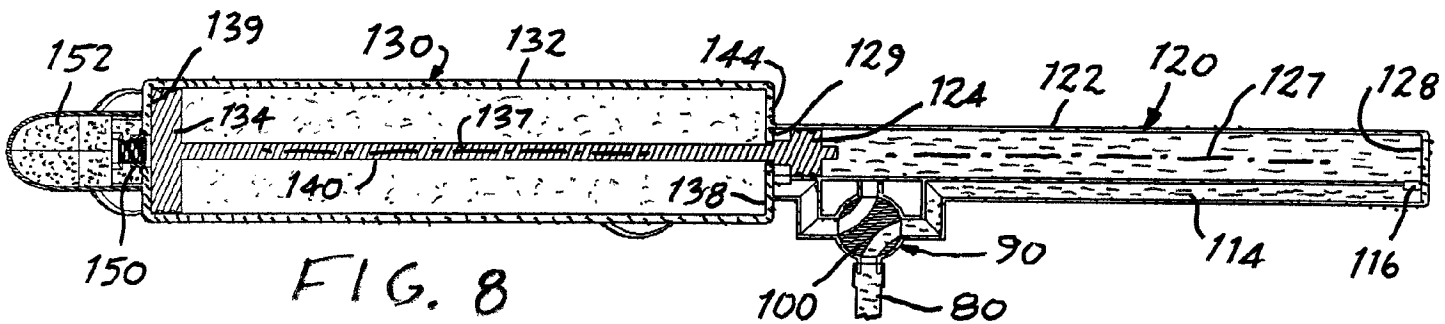

As water under pressure enters water cylinder 122 through opening 116, adjacent near end 128 of the water cylinder 122, water piston 124 is driven along water path of travel 127, as seen in FIG. 7, moving air piston 134 along air path of travel 137 and compressing air in the air cylinder 132. A vent 144 at the near end 138 of the air cylinder 132 enables ambient air to enter air cylinder 132 during such movement of the air piston 134 so that the movement of the air piston 134 is not impeded. The compressed air passes through an air valve in the form of a check valve 150 located at the far end 139 of the air cylinder 132 and into an air chamber 152. Continued movement of water piston 124 brings the water piston 124 adjacent to the far end 129 of water cylinder 122 and moves the air piston 124 to adjacent the far end 139 of the air cylinder 132, as seen in FIG. 8. Compressed air is accumulated in air chamber 152 where the accumulated compressed air remains captive by virtue of check valve 150. In short, the compressed air in air chamber 152 has been generated readily by the pressure available at the convenient source provided by water supply 82, merely by operating valve lever 94.

Figure 9:
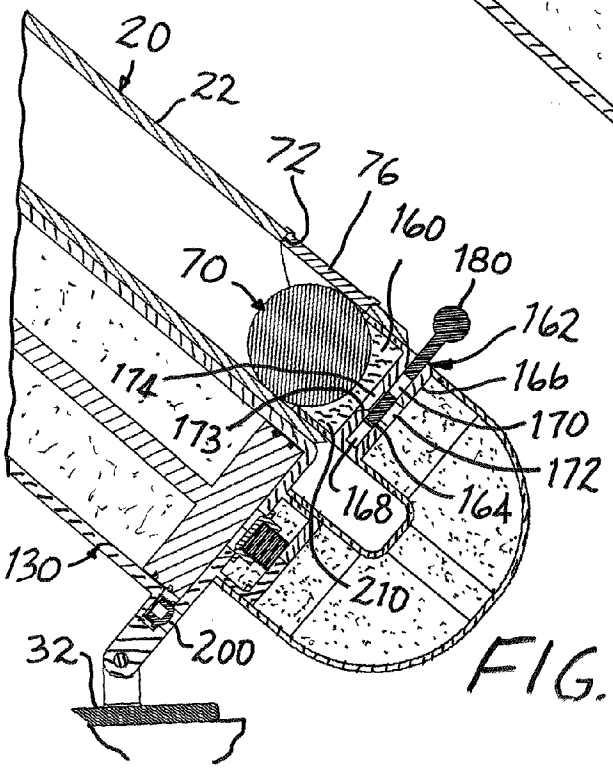
Figure 16:
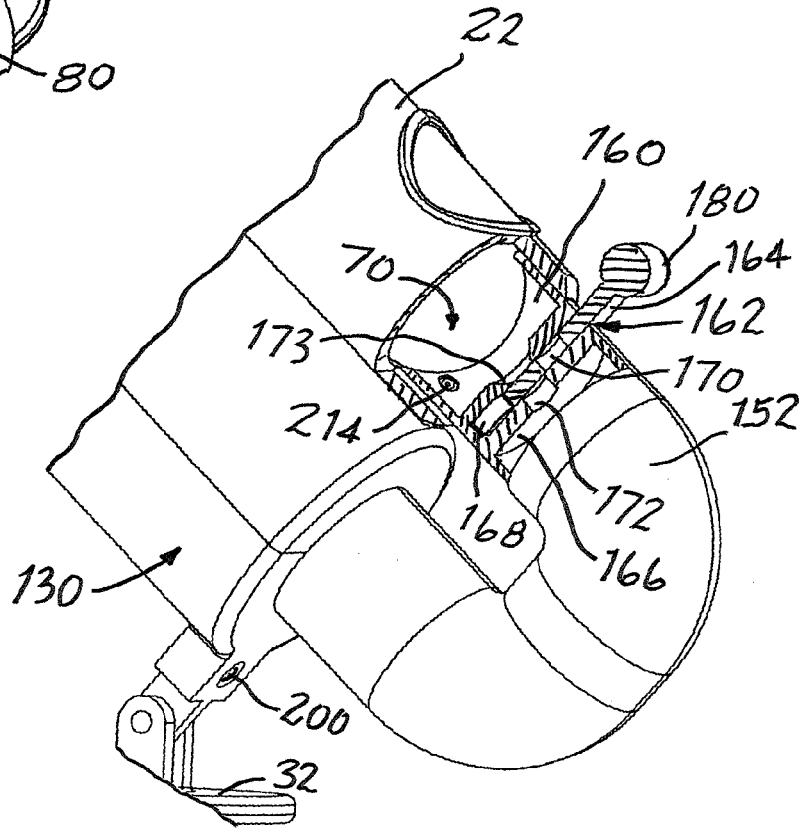
FIG. 16 is rear and left side pictorial view of the toy gun, with portions cut away to show internal details.

Referring now to FIG. 9, insertion of balloon 70 through loading port 72, as described above in connection with FIG. 5, has coupled balloon 70 with a firing chamber 160 located at the lower end 74 of the barrel 22, and the loading port 72 is sealed shut by cover 76. A trigger valve 162 is located between the air chamber 152 and the firing chamber 160 and is seen to include a gate 164 mounted for sliding movement within a complementary seat 166 and biased by a leaf spring 168 (also see FIG. 16) into an upper position, as illustrated in FIG. 9. Gate 164 carries an aperture 170 which passes through the gate 164, and seat 166 includes ports 172 and 173 aligned with one another and together providing an air passage 174 between air chamber 152 and firing chamber 160, which air passage 174 is closed by gate 164 when gate 164 is in the upper position.

Figure 10:
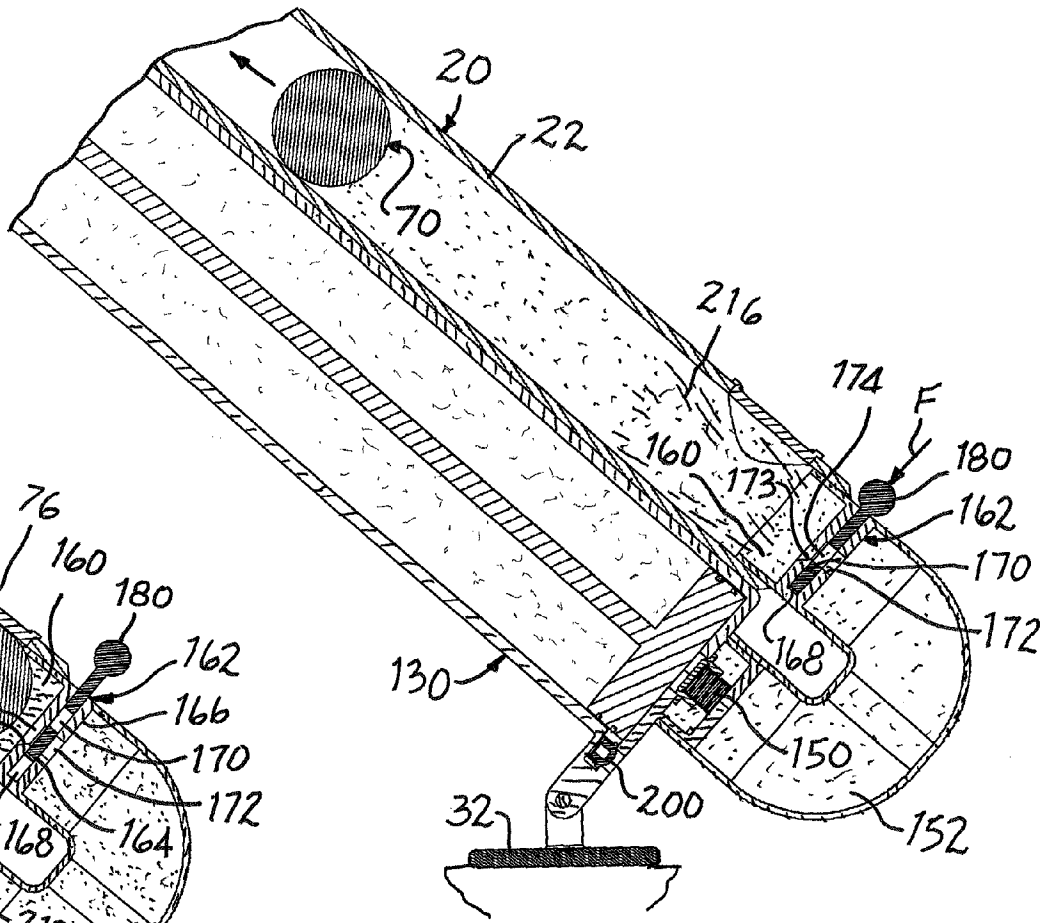
FIGS. 9, 10 and 11 are diagrammatic longitudinal cross-sectional views showing further stages during the cycle of operation of the toy gun.
Figure 11:
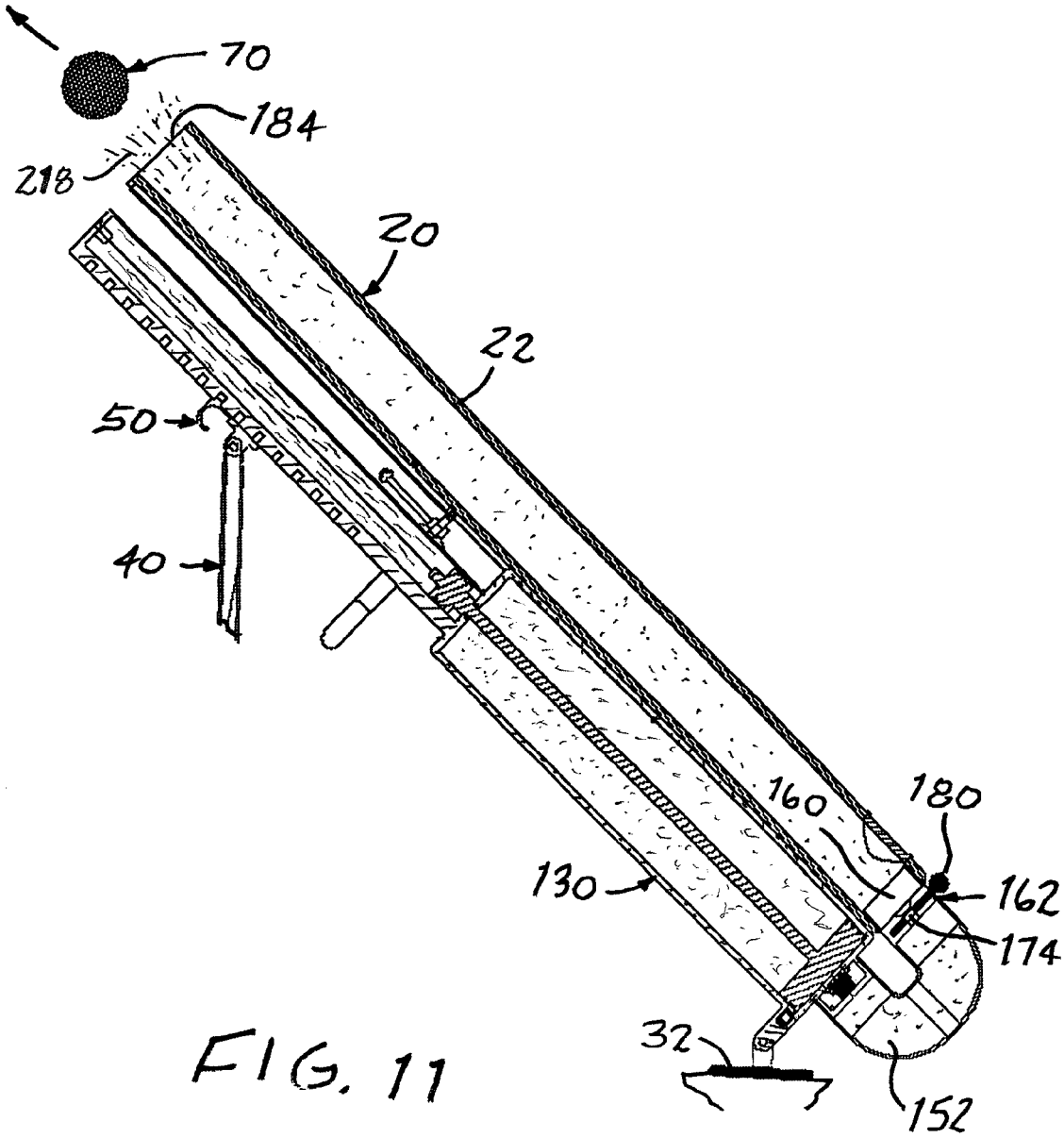

When it is desired to launch balloon 70, trigger valve 162 is operated by rapidly pushing down upon a lobe 180 at the upper end of gate 164, the lobe 180 being integral with the gate 164 and providing a comfortable purchase against which a person's hand (not shown) can exert a quick and effective force F to overcome the bias of leaf spring 168 and move the gate 164 rapidly to a lower position, as shown in FIG. 10. At the lower position of gate 164, aperture 170 is aligned with ports 172 and 173, and the compressed air accumulated in air chamber 152 is released through air passage 174 into firing chamber 160. The size of air passage 174, established by aperture 170 and ports 172 and 173, enables the release of compressed air into firing chamber 160 to provide an essentially instantaneous volume of air under elevated pressure sufficient to propel balloon 70 along the barrel 22, as seen in FIG. 10, and effect launching of the balloon 70 at the mouth 184 of barrel 22, as illustrated in FIG. 11.

Figure 12:
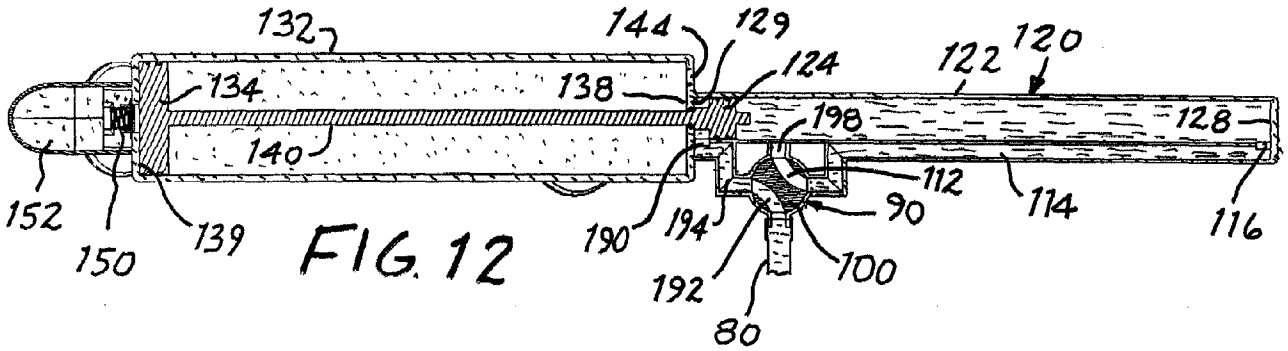
FIGS. 12, 13 and 14 are diagrammatic longitudinal cross-sectional views showing still further stages during completion of the cycle of operation of the toy gun.
Figure 13:
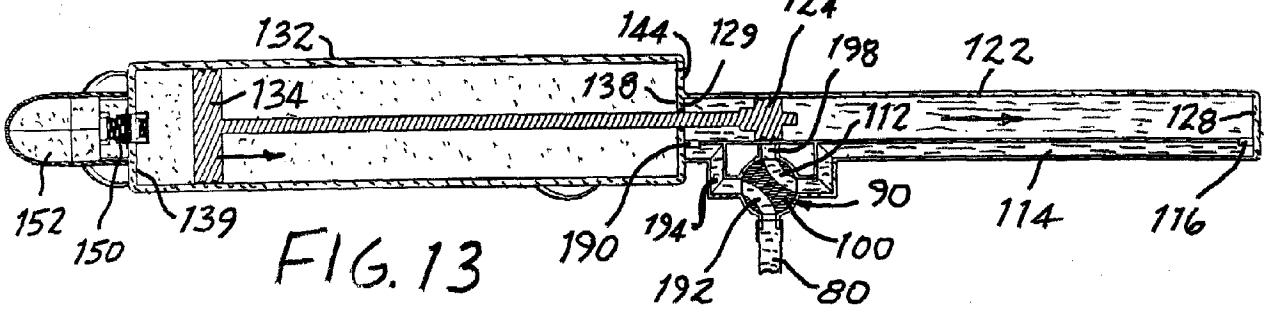
Figure 14:
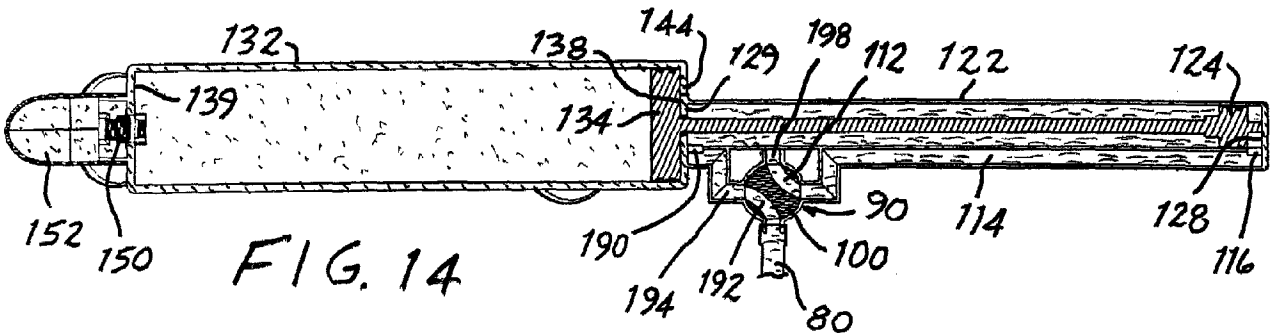
Figure 15:
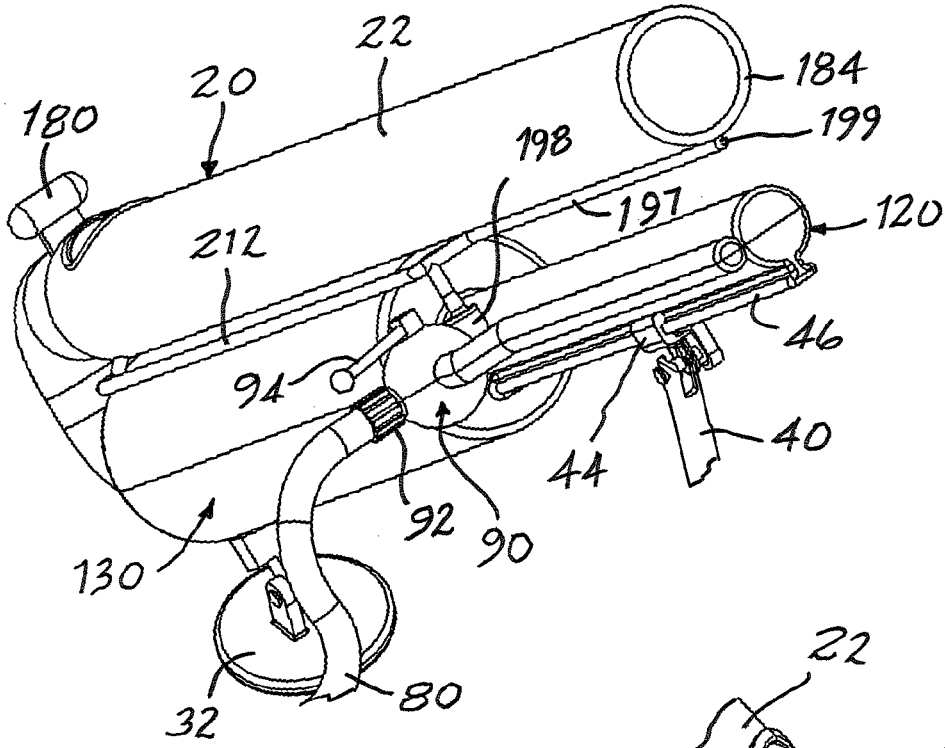
FIG. 15 is a front and right side pictorial view of the toy gun.

Upon completion of a launch, as described immediately above, valve lever 94 is operated to rotate valve core 100 of water valve 90 so as to open communication between garden hose 80 and a second opening 190 in water cylinder 122 of actuator 120, through a second valve passage 192 in valve core 100 and a further conduit 194, as seen in FIG. 12. Water under pressure then is directed to water piston 124, between the water piston 124 and the far end 129 of water cylinder 122, moving water piston 124 in the direction from the far end 129 of the water cylinder 122 toward the near end 128 of the water cylinder 122, as seen in FIG. 13. At the same time, the first valve passage 112 of the valve core 100 opens communication between the first opening 116 and a drain 198, enabling the water which filled the water cylinder 122 between the water piston 124 and the near end 128 of the water cylinder 122 to be driven out of the water cylinder 122, through conduit 114, for discard through a discard orifice 199 located adjacent mouth 184 of barrel 22, via a discard water line 197 which communicates with water valve 90 at drain 198 (see FIG. 15), and returning the water piston 124 to the initial position, as illustrated in FIG. 14, in readiness for another cycle of operation. As the water piston 124 is returned to the initial position, so to is the air piston 134 returned to the initial position, as shown in FIG. 14, drawing a fresh charge of air into air cylinder 132 through a second air valve in the form of a check valve 200 (see FIGS. 9 and 10) at the far end 139 of the air cylinder 132, while exhausting air from between the air piston 134 and the near end 138 of the air cylinder 132 through vent 144. The toy gun 20 thus is made ready for another launching operation. It is pointed out that actuator 120 selectively may be operated through multiple cycles prior to launching a single balloon 70 so as to supply increased amounts of compressed air to air chamber 152, with concomitant higher launching pressures, prior to operating trigger valve 162 to launch the balloon 70.

In order to increase the effectiveness of compressed air in driving balloon 70 out of firing chamber 160, the firing chamber 160 preferably is primed with some water, placed behind the balloon 70, as shown at 210 in FIG. 9. To that end, a small amount of water can be introduced into firing chamber 160, either by pouring water through barrel 22 or through loading port 72, prior to placing balloon 70 into the firing chamber 160. Alternately, with reference to FIGS. 15 and 16, a small volume of water can be introduced into the firing chamber 160 through a water line, shown in the form of priming line 212, which communicates with water valve 90 at the drain 198. Thus, upon operation of the actuator 120 to move the water piston 124 from the near end 128 toward the far end 129 of the water cylinder 122, as described in connection with FIGS. 6 through 8, water in water cylinder 124 which remains between water piston 124 and the far end 129 of the water cylinder 122 from a previous cycle of operation of toy gun 20 as described above, is injected into firing chamber 160, behind balloon 70, by means of a small priming orifice 214 which communicates with the priming line 212. Excess water is discarded through discard orifice 199, via the discard water line 197.

While the priming orifice 214 is of adequate size to pass a sufficient volume of priming water into the firing chamber 160, the very small size of the priming orifice 214, together with the water-filled priming line 212, prevents any significant flow of air under pressure out of the firing chamber 160 through the priming orifice 214, thereby precluding any deleterious diminishing of the effectiveness of the compressed air in launching the balloon 70, as described above. As seen in FIG. 10, the small amount of water previously placed in the firing chamber 160, behind the balloon 70 as shown at 210 in FIG. 9, becomes entrained in the compressed air released from air chamber 152 into firing chamber 160, as illustrated at 216 and travels along the barrel 22 to be expelled at the mouth 184 of the barrel 22, as illustrated in FIG. 11 at 218.

Figure 17:
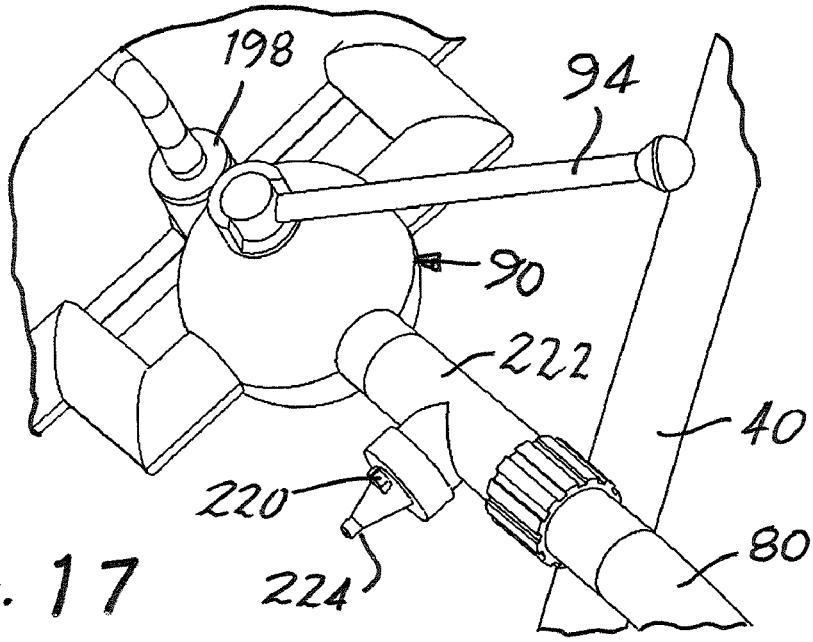
FIGS. 17 and 18 are fragmentary pictorial views illustrating the preparation of a projectile to be launched by the toy gun.
Figure 18:
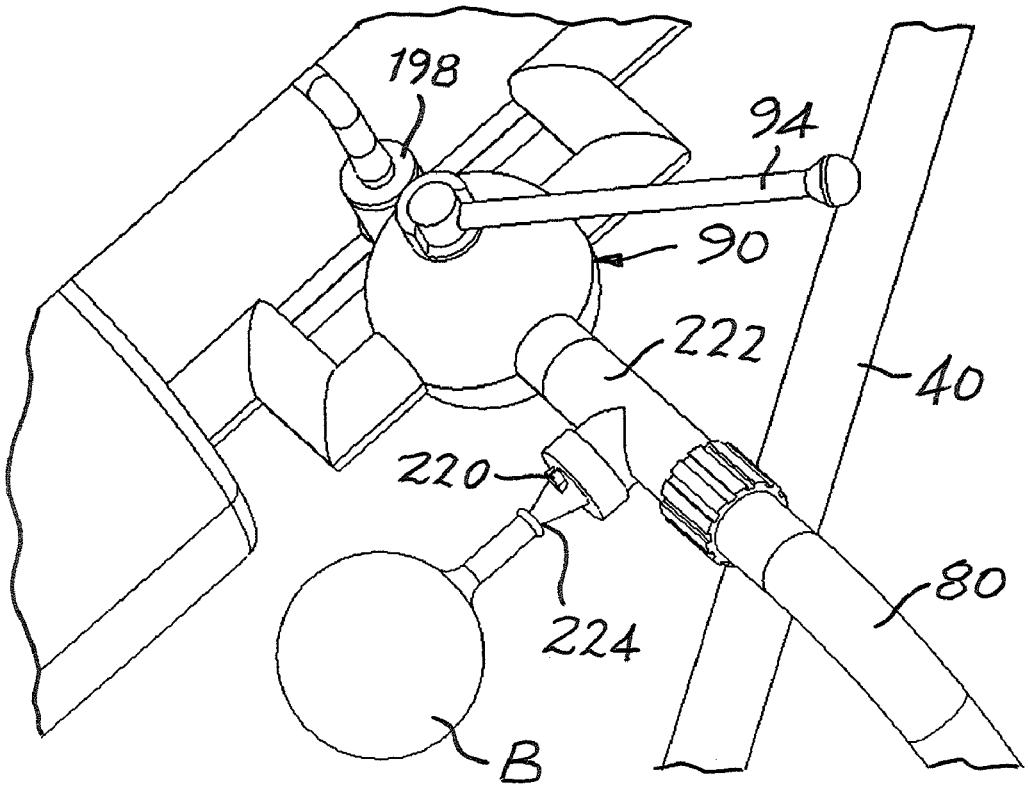

Turning now to FIGS. 17 and 18, toy gun 20 may be provided with a convenient facility for filling a balloon to create a projectile in the form of water-filled balloon 70. To that end, a filler water valve 220 is branched off a filler pipe, shown in the form of inlet pipe 222, placed between the garden hose 80 and the water valve 90. A fitting 224 on the filler water valve 220 enables the temporary coupling of a balloon B with the filler water valve 220 allowing selected entry of water under pressure into balloon B, as illustrated in FIG. 18, to establish an appropriate projectile in the form of water-filled balloon 70.

Figure 19:
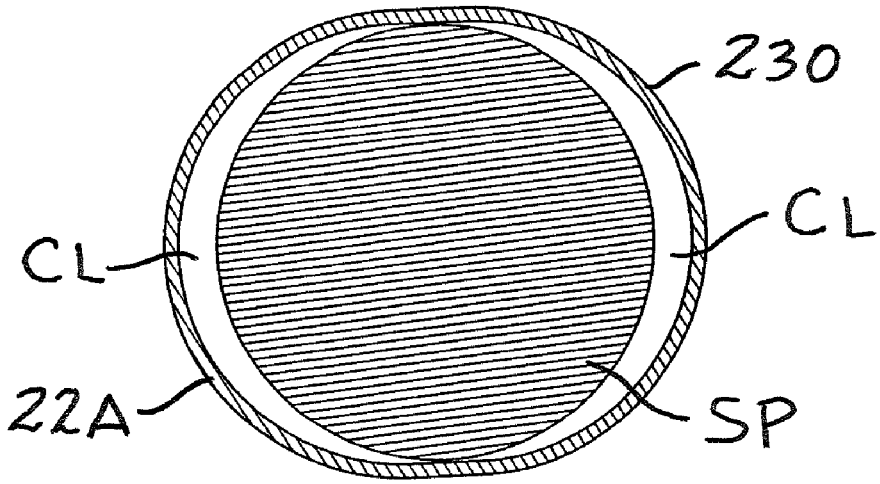
FIGS. 19 and 20 are diagrammatic lateral cross-sectional views showing an optional modification of the toy gun, provided as a safety feature.
Figure 20:
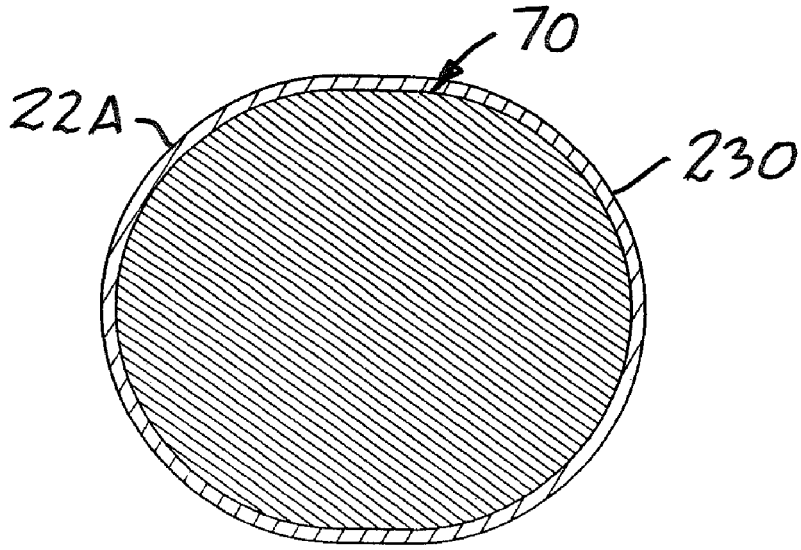

An optional safety feature is illustrated in FIGS. 19 and 20, wherein an alternate barrel 22A is shown provided with a lateral cross-sectional configuration which is slightly out-of-round. In this manner, a dangerously hard, inflexible or heavy spherical projectile SP, such as a billiard ball, a baseball, a bowling ball, a croquette ball, a boule or the like, or any one of a variety of cylindrical objects, will not fill the entire lateral cross-sectional area of the barrel 22A, leaving some clearance CL between the projectile SP and the barrel wall 230, as illustrated in FIG. 19. Much of the air under pressure released from the air chamber 152 into the firing chamber 160 then will bypass the projectile SP and the pressure behind the projectile SP will be insufficient to launch the projectile SP with any significant force. However, as seen in FIG. 20, water-filled balloon 70 is flexible and conformable, and will fill the lateral cross-sectional area of barrel 22A, thus precluding such clearance between the water-filled balloon 70 and the barrel wall 230 as otherwise might impede launching of the water-filled balloon 70 as described above.

Figure 21:
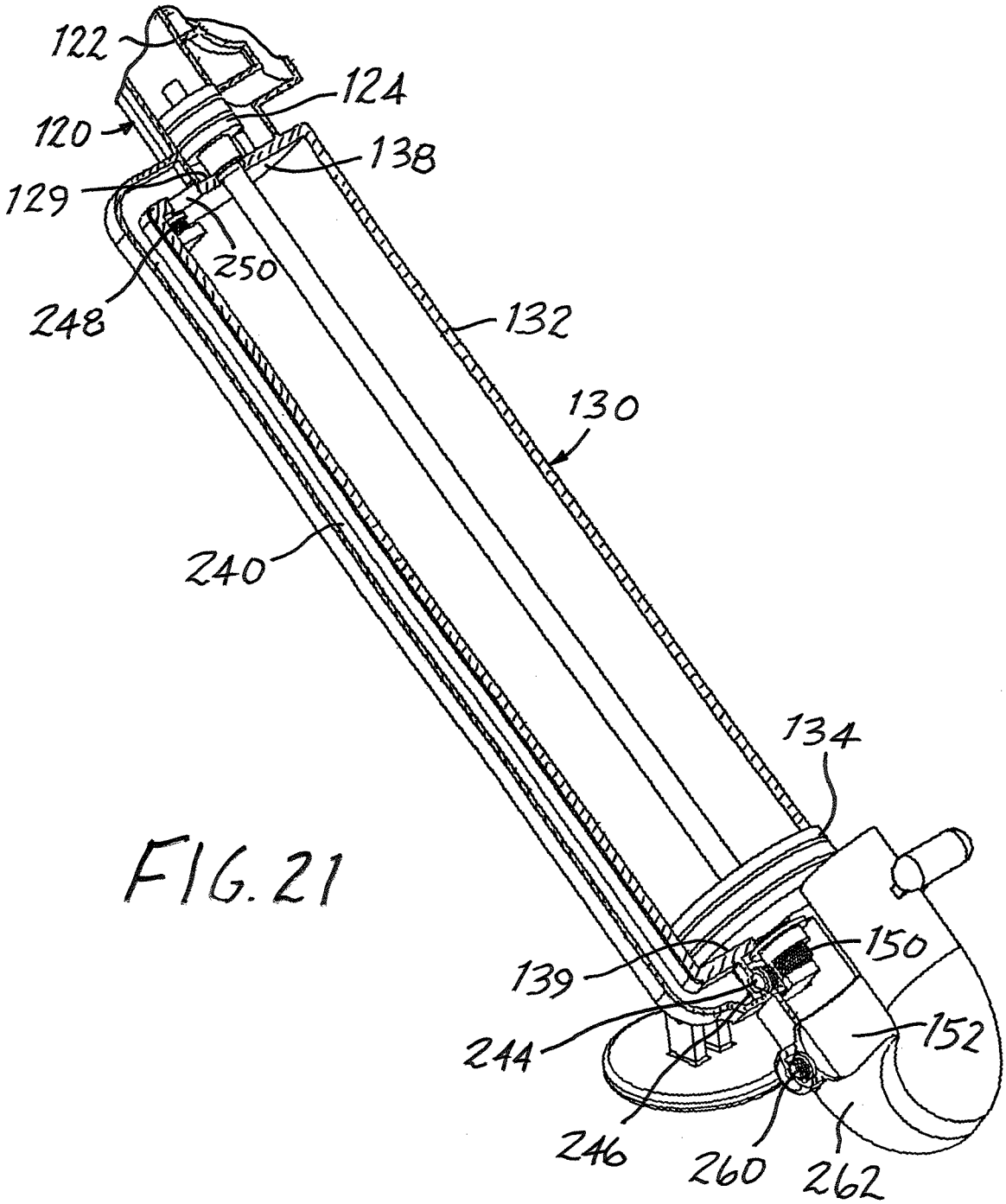
FIG. 21 is a pictorial view with portions cut away illustrating component parts of a toy gun constructed in accordance with another embodiment of the present invention.
Figure 22:
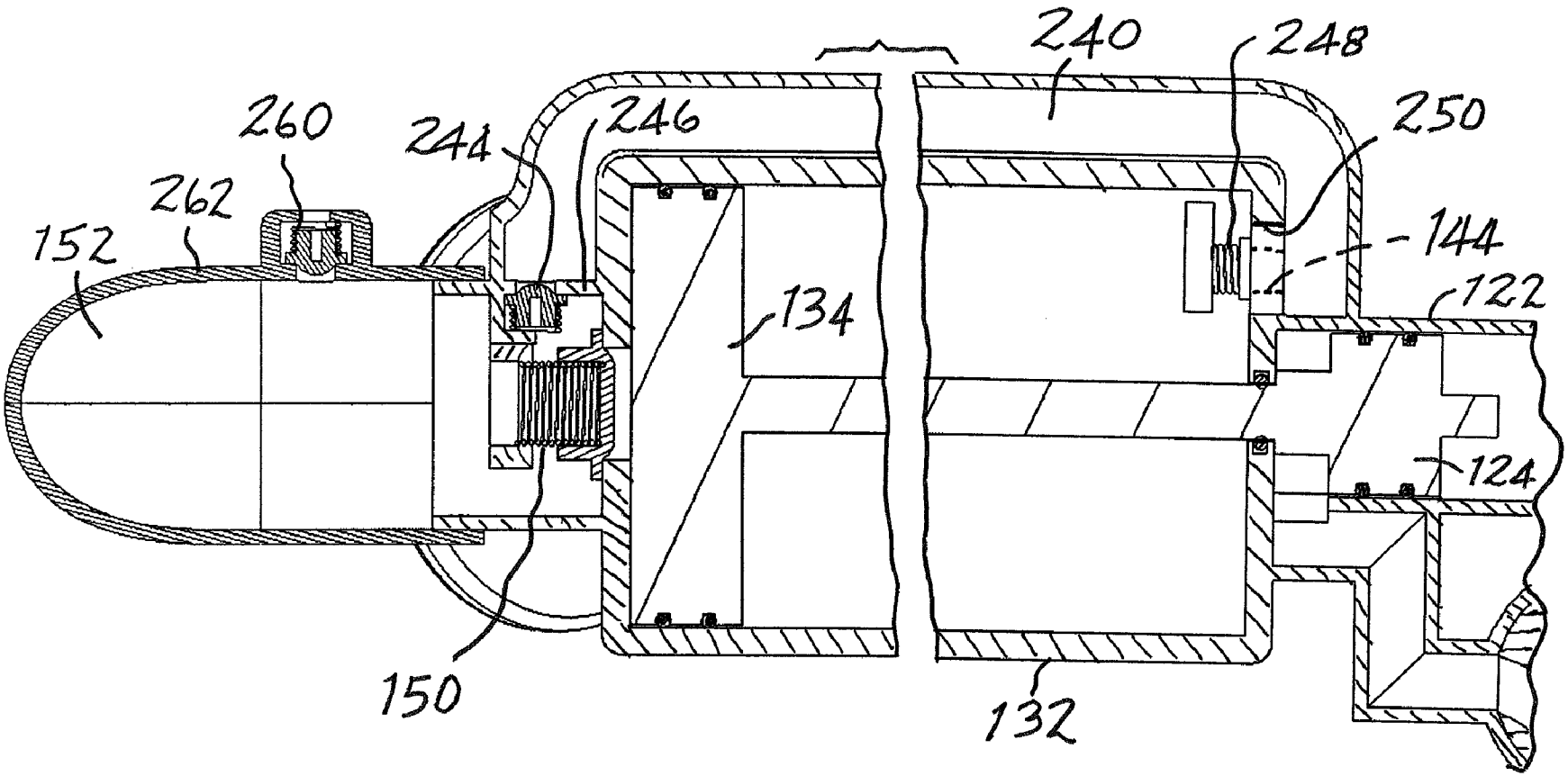
FIG. 22 is an enlarged longitudinal cross-sectional view showing details of construction of the portion of the embodiment of the toy gun illustrated in FIG. 21.

In the embodiment illustrated in FIGS. 21 and 22, compressed air is supplied to the air chamber 152 during movement of the air piston 134 in each of the two opposite directions 136. Thus, an air duct 240 is extended between the near end 138 of the air cylinder 132 and the air chamber 152. Another air valve in the form of a check valve 244 is placed between far end 246 of air duct 240 and air chamber 152, adjacent the far end 139 of air cylinder 132. In addition, a further air valve in the form of a check valve 248 is placed at vent 144.

Upon admitting water under pressure to actuator 120 so as to move water piston 124 and air piston 134 in the direction toward respective far ends 129 and 139 of the water cylinder 122 and the air cylinder 132, as described in connection with FIGS. 6 through 8, compressed air will be driven into air chamber 152, through check valve 150, as before, with check valve 244 precluding the flow of compressed air from the air chamber 152 into the air duct 240. At the same time, a fresh charge of ambient air is admitted into air cylinder 132, between air piston 134 and near end 138 of air cylinder 132, through vent 144, as permitted by check valve 248. However, upon return of the water piston 124 and the air piston 134 toward the respective near ends 128 and 138 of the water cylinder 122 and the air cylinder 132, as described in connection with FIGS. 12 through 14, rather than air being exhausted from air cylinder 132 through vent 144, the flow of air through vent 144 is precluded by check valve 248, and air from between the air piston 134 and the near end 138 of the air cylinder 132 is passed through a further port 250 at near end 138, into air duct 240 and into air chamber 152, as permitted by check valve 244. In this manner, compressed air is generated during movement of the water piston 124 in each of the two directions 126, and the air piston 134 in each of the two directions 136, thereby establishing a "double-action" which increases the supply of compressed air to the air chamber 152 during each complete cycle of operation of actuator 120.

As an added safety feature, a pressure-relief valve 260 is placed in the wall 262 of air chamber 152 to preclude the build-up of excessive air pressure within the air chamber 152. The actuator 120 can be operated through multiple cycles of operation to pass greater volumes of compressed air into air chamber 152, as desired; however, dangerously high air pressure within air chamber 152 is precluded by pressure-relief valve 260.

It will be seen that the present invention attains all of the objects and advantages summarized above, namely: Provides a toy gun powered by a conveniently available source of water under pressure, such as a garden hose, to generate pressurized air for launching a projectile; enables the launching of serial projectiles repetitively with minimal effort, in response to pressurized air; allows the launch of projectiles of relatively higher weight, such as water-filled balloons, in response to readily-generated pressurized air in a toy gun; launches projectiles over a greater range utilizing pressurized air made readily available in a toy gun; simplifies the operation of a toy gun in which pressurized air is utilized for launching a projectile; reduces the effort needed to establish pressurized air within a toy gun which launches a projectile in response to pressurized air; increases the amusement value of toy guns of the type which launch a projectile in response to pressurized air, by reducing the effort required to establish requisite air pressure within the toy gun; provides a toy gun construction and operating procedure which attains exemplary performance over an extended service life.

It is to be understood that the above detailed description of preferred embodiments of the invention are provided by way of example only. Various details of design, construction and procedure may be modified without departing from the true spirit and scope of the invention, as set forth in the appended claims.

The embodiments of the invention in which an exclusive property or privilege is claimed are defined as follows:

1. A toy gun for launching a projectile in response to pressurized air, the toy gun being powered by water under pressure supplied from an available source of water under pressure, the toy gun comprising:

a barrel for launching the projectile;

a firing chamber for being coupled with the projectile to be launched, the firing chamber communicating with the barrel;

an air chamber;

a trigger valve located between the firing chamber and the air chamber for selective movement between a first position, wherein the trigger valve closes communication between the firing chamber and the air chamber, and a second position, wherein the trigger valve opens communication between the firing chamber and the air chamber;

an air compressor communicating with the air chamber for supplying air under pressure to the air chamber while the trigger valve is in the first position;

an actuator coupled with the air compressor for operating the air compressor to supply air under pressure to the air chamber while the trigger valve is in the first position; and a water coupling arrangement for coupling the actuator with the source of water under pressure;

the actuator being arranged for operation in response to water under pressure such that upon introducing water under pressure to the actuator, the actuator will operate the air compressor to supply air under pressure to the air chamber while the trigger valve is in the first position, whereby upon coupling of a projectile with the firing chamber, subsequent operation of the trigger valve to selectively move the trigger valve to the second position and thereby open communication between the air chamber and the firing chamber will release air under pressure from the air chamber to the firing chamber for launching the projectile along the barrel.

2. The toy gun of claim 1 wherein the water coupling arrangement includes a water valve for selectively admitting water under pressure from the source of water under pressure to the actuator.

3. The toy gun of claim 1 wherein:

the air compressor includes an air cylinder and an air piston placed within the air cylinder for reciprocation along opposite first and second air piston directions;

the actuator includes a water cylinder and a water piston placed within the water cylinder for reciprocation along opposite first and second water piston directions;

the air piston is coupled with the water piston for movement along the first and second air piston directions in response to movement of the water piston respectively along the first and second water piston directions; and the air cylinder communicates with the air chamber such that upon movement of the air piston along at least one of the opposite air piston directions, compressed air will be supplied to the air chamber.

4. The toy gun of claim 3 wherein the water coupling arrangement includes a water valve for selectively admitting water under pressure to the water cylinder to move the water piston in at least one of the opposite water piston directions, the one of the opposite water piston directions corresponding to the one of the air piston directions.

5. The toy gun of claim 4 including an air valve arrangement between the air compressor and the air chamber, the air valve arrangement including an air valve between the air cylinder and the air chamber for admitting compressed air from the air cylinder to the air chamber during movement of the air piston in the one of the opposite air piston directions.

6. The toy gun of claim 4 wherein the water valve is configured for selectively admitting water under pressure to the water cylinder to move the water piston selectively in each of the first and second water piston directions.

7. The toy gun of claim 6 including an air valve arrangement between the air compressor and the air chamber, the air valve arrangement including air valves between the air cylinder and the air chamber for admitting compressed air from the air cylinder to the air chamber during movement of the air piston in each of the opposite air piston directions.

8. The toy gun of claim 4 including a water line communicating with the water cylinder and the firing chamber for introducing some water from the water cylinder into the firing chamber during movement of the water piston in at least one of the water piston directions.

9. The toy gun of claim 3 wherein the reciprocation of the air piston is along an air piston linear path of travel.

10. The toy gun of claim 3 wherein the reciprocation of the water piston is along a water piston linear path of travel.

11. The toy gun of claim 3 wherein the reciprocation of the air piston is along an air piston linear path of travel, and the reciprocation of the water piston is along a water piston linear path of travel.

12. The toy gun of claim 11 wherein the water coupling arrangement includes a water valve for selectively admitting water under pressure to the water cylinder to move the water piston in at least one of the opposite water piston directions, the one of the opposite water piston directions corresponding to the one of the air piston directions.

13. The toy gun of claim 12 including an air valve arrangement between the air compressor and the air chamber, the air valve arrangement including an air valve between the air cylinder and the air chamber for admitting compressed air from the air cylinder to the air chamber during movement of the air piston in the one of the opposite air piston directions.

14. The toy gun of claim 12 wherein the water valve is configured for selectively admitting water under pressure to the water cylinder to move the water piston selectively in each of the first and second water piston directions.

15. The toy gun of claim 14 including an air valve arrangement between the air compressor and the air chamber, the air valve arrangement including air valves between the air cylinder and the air chamber for admitting compressed air from the air cylinder to the air chamber during movement of the air piston in each of the opposite air piston directions.

16. The toy gun of claim 1 wherein the projectile is a water-filled balloon and the toy gun includes an filler pipe placed between the coupling arrangement and the actuator, and a filler water valve branched off the filler pipe, the filler water valve having a fitting for enabling the selective coupling of a balloon with the fitting and operation of the filler water valve to admit water from the source of water under pressure to the balloon for filling the balloon with water from the source of water under pressure to prepare a projectile.

17. The toy gun of claim 1 wherein the barrel extends in a longitudinal direction and has a slightly out-of-round lateral cross-sectional configuration.

18. A method for launching a toy projectile utilizing water under pressure, from an available source of water under pressure, comprising:

coupling the projectile with a firing chamber adjacent a barrel;

admitting water under pressure from the source of water under pressure into an actuator coupled with an air compressor to create compressed air in response to admitting water under pressure into the actuator;

accumulating the compressed air in an air chamber; and subsequently opening communication between the air chamber and the firing chamber, such that the open communication provides the firing chamber with an essentially instantaneous volume of compressed air under pressure sufficient to effect launching of the projectile along the barrel.

19. The method of claim 18 wherein the step of coupling the projectile with the firing chamber includes placing the projectile in the firing chamber to effect launching of the projectile through the barrel.

20. The method of claim 19 including placing some water in the firing chamber, between the projectile and the air chamber, prior to opening communication between the air chamber and the firing chamber.

* * * * *